US005395015A

United States Patent [19]

Bolen, Jr. et al.

[11] Patent Number: 5,395,015

[45] Date of Patent: Mar. 7, 1995

[54] DISPENSING CLOSURE WITH A MODIFIED LID FOR INCREASED OPENING ANGLE

[76] Inventors: Robert J. Bolen, Jr., 10 Gwynne Ct., Closter, N.J. 07624; Thomas R. Bolen, 312 Dayton St., Ridgewood, N.J. 07450

[21] Appl. No.: 135,256

[22] Filed: Oct. 12, 1993

Related U.S. Application Data

[63] Continuation-in-part of Ser. No. 656,309, Feb. 15, 1991, Pat. No. 5,251,793, which is a continuation of Ser. No. 493,828, Mar. 15, 1990, Pat. No. 4,993,606, which is a continuation of Ser. No. 214,676, Jul. 1, 1988, abandoned.

[51] Int. Cl.[6] ..... B65D 47/08

[52] U.S. Cl. ..... 222/546; 215/235; 220/338; 222/556

[58] Field of Search ..... 222/517, 546, 556; 215/235, 237; 220/334, 335, 338, 342

[56] References Cited

U.S. PATENT DOCUMENTS

| | | | |
|---|---|---|---|
| D. 274,309 | 6/1984 | Aldrich . | |
| D. 306,701 | 3/1990 | Beck . | |
| 2,765,094 | 10/1956 | Ryan | 220/338 |
| 3,308,835 | 3/1967 | Silverberg . | |
| 3,651,992 | 3/1972 | Hazard | 215/237 X |
| 3,782,583 | 1/1974 | Abbey . | |
| 4,441,637 | 4/1984 | Libit . | |
| 4,460,100 | 7/1984 | Libit . | |
| 4,518,094 | 5/1985 | Kodman . | |
| 4,545,495 | 10/1985 | Kinsley . | |
| 4,625,898 | 12/1986 | Hazard . | |
| 4,632,266 | 12/1986 | Osswald . | |
| 4,666,068 | 5/1987 | Bush | 222/556 X |
| 4,717,050 | 1/1988 | Wright . | |
| 4,723,693 | 2/1988 | DeCoster . | |
| 4,735,334 | 4/1988 | Abbott . | |
| 4,742,928 | 5/1988 | Braun . | |
| 4,793,501 | 12/1988 | Beck . | |

FOREIGN PATENT DOCUMENTS

| | | |
|---|---|---|
| 573304 | 6/1988 | Australia . |
| 48565 | 7/1974 | Finland . |
| 84899 | 10/1991 | Finland . |
| 3422546 | 12/1984 | Germany . |
| 3523657 | 4/1986 | Germany . |
| 3710979 | 11/1987 | Germany . |

OTHER PUBLICATIONS

The 1985 Packaging Encyclopedia, p. 9.

*Primary Examiner*—Kevin R. Shaver
*Attorney, Agent, or Firm*—Davis Hoxie Faithfull & Hapgood

[57] ABSTRACT

A two piece dispensing closure for a container with a dispensing orifice in the front section and an elevated rear land that has a pivot recess adapted to receive a separate lid with a recess or groove which enables the lid to be rotated to about 150° from the closed position. The front section of the lid is generally circular with a pivot post at its rear. A chamfered elevated land which saves plastic material and is easier to mold, is also disclosed.

20 Claims, 6 Drawing Sheets

DISPENSING CLOSURE WITH A MODIFIED LID FOR INCREASED OPENING ANGLE

The present application is a continuation-in-part of U.S. Ser. No. 07/656,309, which was filed on Feb. 15, 1991, and issued on Oct. 12, 1993, bearing U.S. Pat. No. 5,251,793, which is continuation of U.S. Ser. No. 07/493,828, which was filed on Mar. 15, 1990, and issued on Feb. 19, 1991, bearing U.S. Pat. No. 4,993,606, which is a continuation of U.S. Ser. No. 07/214,676, which was filed on Jul. 1, 1988, and was abandoned.

BACKGROUND OF THE INVENTION

The present invention relates generally to a dispensing closure for containers and more particularly to a two piece dispensing closure, wherein a hinged lid is moved from a base of the closure to uncover an orifice through which the container contents are dispensed. This type of closure is made from molded plastic and used extensively in dispensing food products, such as salad dressings, and for personal care and household products.

The typical dispensing closure for a container comprises a generally circular base with a dispensing orifice in the front section of the upper surface and an annular skirt depending downwardly from the upper surface that is adapted to engage and secure the base to the container, usually by means of internal threads that are screwed onto the neck of the container. A lid having a plug on its underside for sealing the dispensing orifice is adapted to be pivotally moved with respect to the base to be opened and closed by the pressure of the finger or thumb.

In many instances the base and lid of the closure are molded as a single unit, the lid being connected to the base by a flexible hinge, which is known in the industry as a "living hinge." A disadvantage of the "living hinge" is that the hinge portion of the closure has a tendency to crack, and eventually break, separating the lid from the base. Also, when the lid is rotated from the open position, it reaches a point from which it tends to snap rapidly to the closed position, and can splash liquid product, or even catapult one or more drops toward the user's face or clothing, thus presenting some danger if the product is an irritant.

Moreover, in the "living hinge" design, at least a portion of the hinge necessarily extends beyond the circumferential periphery of the closure of the rear of the base and creates problems during the assembly line filling of the container in that such an eccentric shape is subject to bumping and breakage, and can interfere with the highly automated equipment used during assembly of the closure and container of the product to be marketed.

The "living hinge" design has been replaced to some extent by a dispensing closure design where the base has a notch located at the approximate center of top, and a relatively narrow rectangular channel extends from the notch to the front edge of the base with a dispensing orifice positioned in the channel proximate the front edge. A lid having a generally flat upper surface which terminates in a downwardly depending flange and indented end pieces is adapted to be received in a snap-fit into the notch, and when rotated to the closed position, lies entirely within the channel. The underside of the lid has an annular plug which mates with, and seals the orifice. The lid is maintained in the open position by means of an interference fit between the bottom edge of the flange and lugs located at the forward edge of the bottom of the notch where it intersects the rear of the channel. The lid is maintained in the notch in the open position by contact between a groove in the leading edge of the flange and a tab protruding upwardly from the intersection of the front wall and bottom of the notch.

Another type of dispensing closure has been developed where the base and a dispensing nozzle, or spout, comprise two separate components that are interconnected through a modified ball and socket joint, or protruding pin or post from one component mating with a corresponding recess in the other component to form a pin/recess hinge structure between the two components. In one form of the pin/recess hinge design, the outer surface of the base of the closure has a notch formed therein, said notch being shaped to receive one end of a hollow dispensing type nozzle of the lid which has a passageway for the liquid product. In the fully open position the nozzle communicates with the inside of the container by means of an orifice through the base located in the bottom of the notch. The nozzle end portion mates in a modified ball and socket configuration when press fit into the notch in the base. This latter ball and socket hinge design further relies upon a key-slot configuration in the notch of the base and the portion of the dispensing nozzle to be disposed within the notch, respectively, to limit the open position of the dispensing nozzle type lid, as well as interfering projections on the forward face of the notch and on the portion of the nozzle disposed within the notch to maintain the nozzle in an open position during the dispensing of product from the container. The interference fit yields to finger pressure to move the nozzle through the interference fit and return the lid to a closed position on the base of the closure.

In another form of two piece dispensing closure, the lid is circular and the end of the lid opposite the orifice contains two slots which mate with two posts extending upwardly from the surface of the base of the circular closure at its periphery. In this slot and post design, the posts are flexible and exposed, and are therefore subject to damage during handling of the closure or container. In addition, the lid is insecurely held in place, is subject to twisting and lateral movement, and is easily pulled from the posts when the lid is in the open position.

In U.S. Pat. Nos. 5,251,793 and 4,993,606, and Pat. No. Des. 334,538, the applicants disclosed improved two piece dispensing caps which overcame the disadvantages described above. The base of the caps have a top surface portion and a skirt depending downwardly from the top surface. The top surface includes a dispensing orifice. An elevated land is provided contiguous to the top surface and spaced from the dispensing orifice. The elevated land includes a recess spaced from its periphery bordering the skirt, for pivotally affixing a lid. The recess is disposed to align a plug on the lid with the dispensing orifice, to allow mating of the plug and orifice. Those caps are much more secure and easier to use than prior art dispensing closures.

In a fully open position, however, the lids on such caps, can only be rotated to about 115° before the rear portion of the top of the lid interferes with the rear portion of the elevated land. In that position, the lid could interfere with dispensing product. It can also interfere with the user or the environment where product is to be dispensed. It would be desirable, therefore, to be able to rotate the lid to at least about 150° in the fully open position, to more completely avoid interference with dispensing.

In addition, the elevated lands in the caps disclosed in U.S. Pat. Nos. 5,251,793 and 4,993,606 may be bulkier than necessary to secure the lid. Excess bulk increases the cost of the cap and can cause molding problems. It would therefore also be desirable to provide a more streamlined elevated land.

It is a principal object of the invention to provide a two piece dispensing cap whose lid can be rotated to about 150° with respect to the surface of the base, when in a fully opened position.

A further object of the invention is to provide a two piece dispensing closure with an elevated land with less bulk which is more economical and easier to mold.

With these and other objects in view, as will be apparent to those skilled in the art, the invention resides in the combination of parts set forth in the specification and covered by the claims appended hereto.

SUMMARY OF THE INVENTION

In one embodiment of the present invention, a two piece dispensing closure for a container is disclosed comprising a lid having a bottom surface with a plug for sealing a dispensing orifice and a top surface. A base member is provided having a top surface portion and a skirt depending downwardly from the top surface. The top surface portion has a dispensing orifice. An elevated land contiguous to the top surface portion and spaced from the dispensing orifice is provided having a recess spaced from its periphery bordering the skirt of the base for pivotally affixing the lid. The recess is disposed so as to align the plug with the dispensing orifice and thereby allow mating of the plug and orifice. The lid further comprises a recess in its top surface for receiving a portion of the elevated land when the lid is rotated to a fully opened position. The lid can have a pivot post engaged in the recess of the elevated land and the recess in the lid can be in the pivot post. The recess can be a groove or can extend across the length of the lid.

In another embodiment of the invention, the elevated land is chamfered to lessen its bulk. The elevated land can be defined in part by a pair of forward walls extending from the periphery of the base. The origins of the forward walls lie on the periphery of the base while the terminuses of the forward walls lie within the periphery of the base. The origins are rearward of the terminuses.

The forward walls can further comprise a pair of front walls lying within the periphery of the base and a pair of side walls. The origins of the side walls lie on a portion of the periphery of the base rearward of the front walls and the side walls extend to the front walls.

A two piece dispensing closure for a container is also disclosed comprising a generally circular base having a top and a front section, the base comprising a cover portion at least partially spanning the top of the base and having a generally semi-circular forward top surface in the front section of the base, and an annular skirt depending downwardly from the cover portion. A dispensing orifice is provided in the generally semi-circular forward top surface of the cover portion. The dispensing orifice has a rim and the top surface portion does not extend above the rim. A lid having a bottom surface with a plug for sealing the dispensing orifice and a pivot post is also provided. An elevated rear land extending upwardly from and above the annular skirt, contiguous with the generally semi-circular forward top surface of the cover portion and behind the dispensing orifice has a pivot recess spaced from its periphery for pivotally receiving the lid. The pivot recess is disposed to align the plug with the dispensing orifice and thereby allow mating of the plug and orifice when the lid is in the closed position. The pivot post further comprises a recess extending across its width, for receiving a portion of the elevated land when the lid is rotated to a fully opened position.

BRIEF DESCRIPTION OF THE DRAWINGS

The invention will be best understood by reference to one of its structural forms, as illustrated by the accompanying drawings, in which.

DESCRIPTION OF THE PREFERRED EMBODIMENTS

Figure 1:
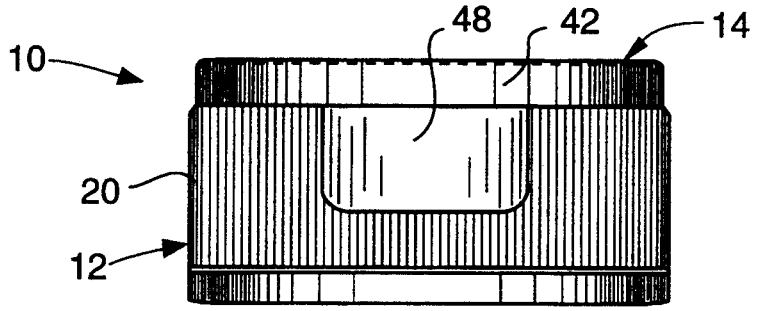
FIG. 1 is a front elevational view of a two piece dispensing closure in accordance with the first embodiment of the present invention.
Figure 2:
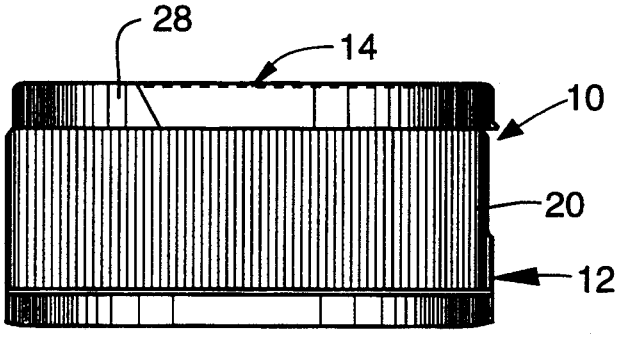
FIG. 2 is a left hand elevational view of the closure of FIG. 1.
Figure 3:
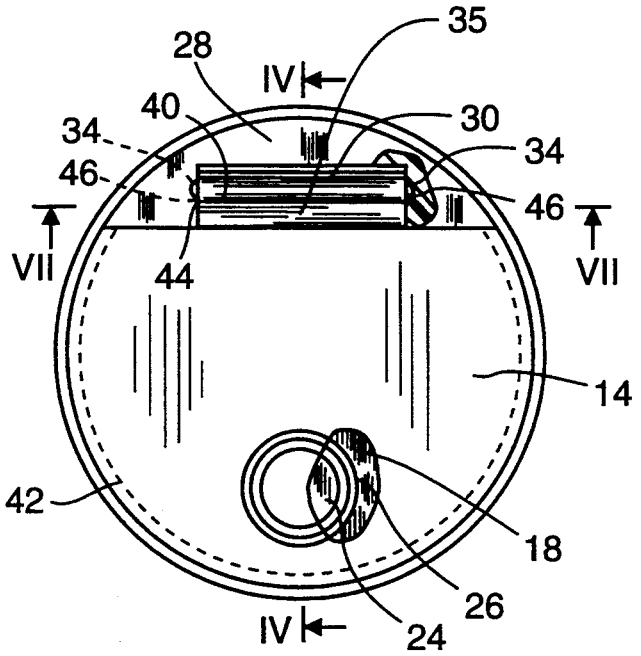
FIG. 3 is a plan view of the closure of FIG. 1, with cut-away sections.

FIGS. 1–7 illustrate the first embodiment of the present invention. The two piece dispensing closure is generally indicated by reference numeral 10 and comprises a base which is generally indicated by the reference numeral 12 and a lid which is generally indicated by the reference numeral 14. The base 12 includes a circular cover portion 16 which has a generally semi-circular forward top surface 18 and an annular skirt, or side wall, 20, which is provided with internal threads 22 to enable the cap to be threaded onto the threaded neck of a container.

Other means of affixing the closure to a container may be employed. Such means are well known to those skilled in the art and includes bayonet lugs and channels, or a snap fit bead and recess. The cover portion 16 of the base 12 has a dispensing orifice 24, preferably having an upstanding annular rim 26.

Figure 4:
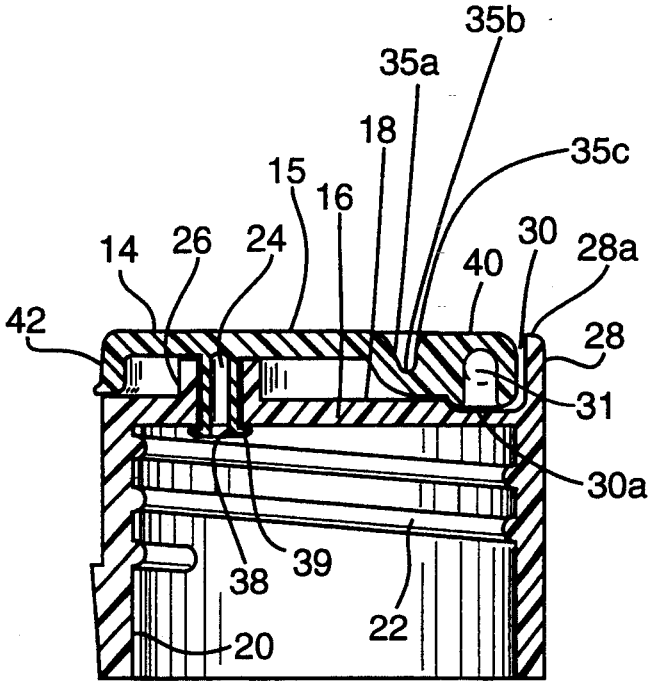
FIG. 4 is a vertical cross-sectional view of the closure taken along line IV—IV of FIG. 3, and looking in the direction of the arrows.

The cover portion 16 has an elevated rear land section 28 extending upwardly above the annular skirt 20, behind the dispensing orifice 24. The elevated land portion 28 has a substantially rectangular pivot recess 30. The pivot recess 30 is defined by a pair of vertical side walls 32, each wall 32 having a circular indent 34 and a rear wall 31. The front walls 36 of the elevated land are preferably outwardly sloping, which facilitates removal of the cap from the mold. The bottom surface 30*a* of the pivot recess 30 may extend below the top surface 18 of the base 12, as shown in FIG. 4.

Figure 5:
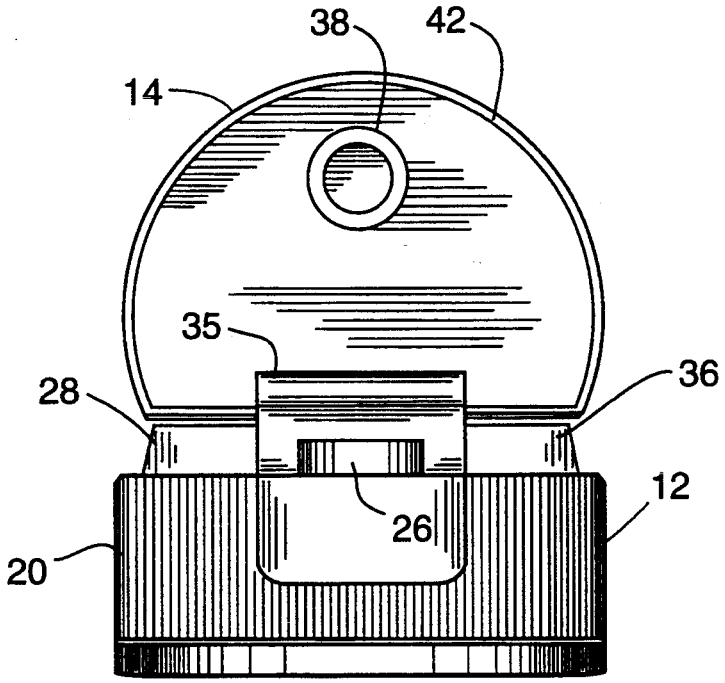
FIG. 5 is a front elevational view of the closure with the lid in the open portion.
Figure 6:
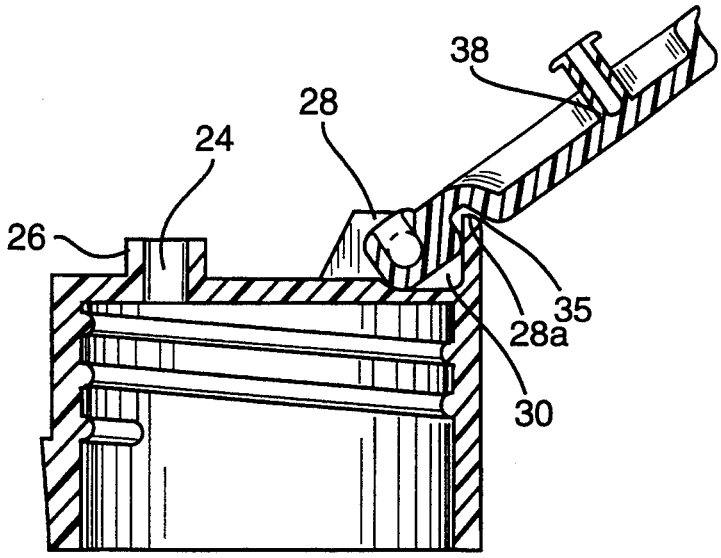
FIG. 6 is a vertical cross-sectional view similar to FIG. 4, showing the lid in the open position.

The lid 14 has a top portion 15 and a skirt portion 42 that is best shown in FIGS. 5 and 6. The skirt portion closes down on the periphery of the base 12 when the lid 14 is in the closed position. The lid 14 is further provided with an annular plug 38 which extends downwardly from the bottom surface of the lid so that it mates with and seals the orifice 24 when the lid is in the closed position as shown in FIG. 4. The end of the plug 38 is preferably provided with a bead, or flange 39, that provides a secure interference fit with the narrowed throat 25 as it is pressed into the orifice 24.

At the opposite end of the lid, a pivot post 40 is dimensioned so as to be securely received in the recess 30, and terminates in an end portion which has side surfaces 44, each surface having a spherical, or rounded, projection 46 which complements and is snapped into the indents 34 in each of the side walls of the recess 30. The combination of the projections 46 and indents 34 forms a hinge connection between the lid 14 and the base 12, and can be reversed so that one or both of the indents are on the pivot post of the lid. This configuration enables the lid 14 to be pivoted from a closed position as shown in FIG. 4, in which the lid is flush with the top surface 28*a* of the rear land 28 and the orifice 24 is sealed by the plug 38, to an open position shown in FIG. 6. In this embodiment, when the lid 14 is in the closed position as shown in FIG. 4, the top surfaces of the lid 14, including the pivot post 40, and the elevated section 28, all preferably lie in the same horizontal plane. In addition, the configuration also provides the means for securely holding the cap in the base.

The top of the lid 14 includes a recess, such as groove 35, for receiving the rear portion 28*a* of the elevated land 28 when the lid approaches the fully opened position, as shown in FIG. 6. The groove has a front wall 35*a*, which is preferably sloped toward the front of the lid, a bottom wall 35*b* and a rear wall 35*c*. In the embodiment illustrated in FIGS. 1–7, the groove 35 extends across the width of the pivot post 40. Depending on the size of the elevated land and location of the hinge connection between the lid 14 and the base 10, the recess could need to be located at other portions of the lid 14.

The groove 35 enables the lid to be rotated farther during opening, lessening possible interference of the lid with dispensing product, the user or the environment the product is being dispensed in. In the fully opened position, the lid 14 with the groove 35 can be rotated to about 150° with respect to the closed position. Without the recess, the lid could only be rotated to about 115°. Such a recess can be provided because the elevated land 28 positions the lid 14 above the top surface 18 of the base 10. The distance between the lid 14 and that top surface 18 is used to accommodate the recess.

Figure 8:
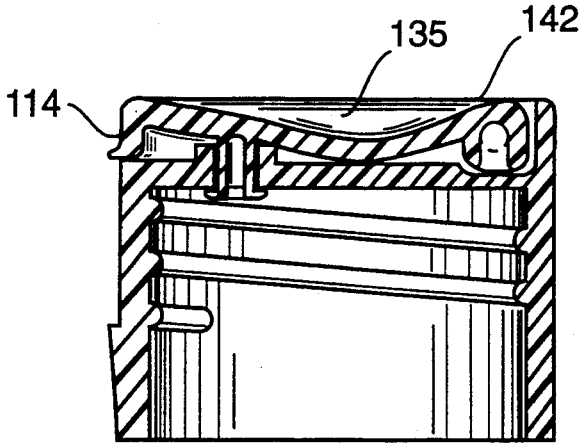
FIG. 8 is a vertical cross-sectional view, similar to FIG. 4, of another embodiment of the present invention.

In another embodiment, instead of being a groove, the recess 135 can extend across the entire length of the lid 114, as shown in FIG. 8. The top of the lid 114 is preferably concave and preferably includes a depending skirt 142. Other portions of the closure are the same as described with respect to FIGS. 1–7.

Returning to the first embodiment of FIGS. 1–7, when the lid is in closed position, the skirt 142 of the lid continues the line of the side wall of the elevated rear land 28, to give the appearance of a continuous vertical wall to the closure. The longitudinal and vertical continuity of the closure thus provides an aesthetically pleasing appearance, and to some degree provides a child-resistant safety feature in that the means of gaining entry to the container contents is not immediately apparent. Moreover, the defined structure has the appearance of a one piece cylindrical cap. With the elevated rear section design of the subject closure and a lid covering a limited portion of the surface of the base, a dispensing orifice having an annular rim of substantial height may be used. It is desirable to have the rim defining the pour orifice of substantial height to permit cleaner dispensing that is less prone to dripping. Also, the hinge elements of the closure are well protected within the confines of the recess 30, and the underside of the base is planar.

It is desirable that the rear wall 31 of the pivot recess 30 be substantially flat so as to provide a surface against which the upper surface of the pivot post 40 may abut in the open position. This abutment, together with the stable frictional interfit of the projections and indents of the hinge, provides a rigid mounting that is substantially aided in retaining its lateral stability due to inability of the side walls of the recess to move away from the mating side walls of the pivot post. This interfit stability is far superior to the relatively unstable interfit between the posts and lid of the prior art in which the open lid can easily be separated from the base.

Figure 6A:
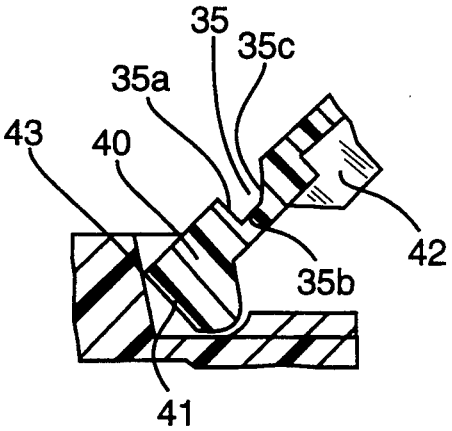
FIG. 6A is an enlarged sectional view of the hinge portion of the closure of FIG. 6.

The lower terminus of the pivot post 40 is preferably generally circular in cross section, with a tangential surface intersecting the upper surface of the pivot at essentially a right angle along edge 43, as shown in FIG. 6A. As the lid is rotated from the closed position, edge 43 of the pivot post 40 contacts the rear wall 31 in an interference fit and then again freely rotates to the fully open position. This interference fit prevents the open lid from closing unless a slight finger pressure is applied. This feature is most desirable when dispensing products from the container with an accompanying shaking motion, which would otherwise tend to move the lid to a closed position. If this occurred during dispensing so as to interfere with the flow path of the product, the undesired consequences are obvious—the product would likely be directed to the user rather than the zone of desired impingement. This means for retaining the lid in the open position also eliminates the potential for splashing which can occur with the spring action "living hinge" of the prior one-piece closures which snap to a closed position. This interference fit is thus accomplished in general by employing an eccentric-concentric design for the rear wall of the recess and pivot post end.

Also as best illustrated in FIG. 6A, the rear wall 31 is inclined from the vertical toward the rear of the base.

Figure 6B:
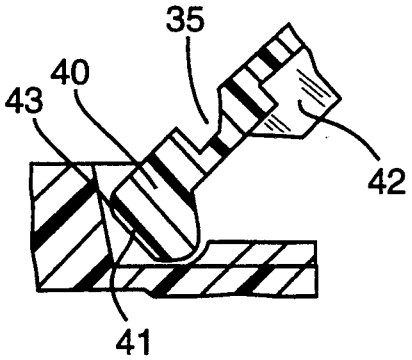
FIG. 6B is an enlarged sectional similar to FIG. 6A, illustrating a different embodiment of the lid.
Figure 7:
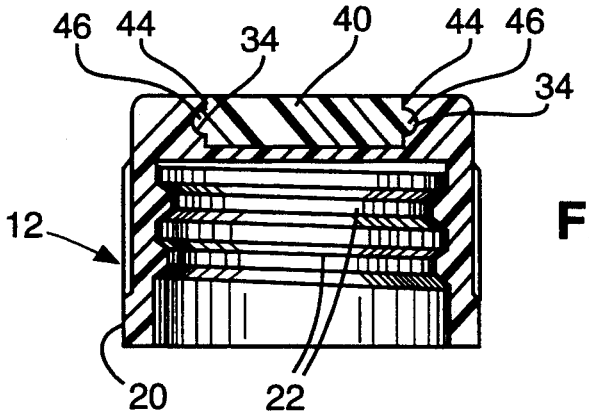
FIG. 7 is a vertical cross-sectional view of the closure taken along the line VII—VII of FIG. 3, looking in the direction of the arrows.

FIG. 6B illustrates another modification of the pivot post in which the rear edge 51 of the lid is rounded, so that there is no interference fit with the rear wall 31 as the lid is raised and lowered. In the configuration of FIG. 6B, the lid is maintained in the open position by virtue of the frictional fit of the ends of the pivot post in the recess.

As will also be appreciated by one skilled in the art, the configurations of the recess and pivot post can be modified in various ways to produce the functionally equivalent relationship with the base of the closure. Thus, the pivot post can take the configuration which more nearly resembles a conventional ball joint and the recess likewise modified to the shape of a socket adapted to receive the ball. Other configurations known in the art can be adapted to configure the downwardly depending extension 40 from the rear of the generally circular front section 15 of the lid 14 to mate with the pivot recess 30 in a hinge relationship which has a center of rotation located within the recess.

As will be apparent from the drawings, the axis of rotation of the lid is along a chord, or line, which is perpendicular to the diameter passing through the center of the dispensing orifice. Further, the axis of the recess is preferably displaced on the opposite side of a diameter drawn between the recess and the dispensing orifice. The length of the recess along the axis of rotation is preferably approximately one-third to one-half the diameter of the closure and it is located at a distance of approximately two-thirds to three-quarters of the diameter from the front skirt or wall of the closure nearest the dispensing orifice.

The base skirt 20 is preferably provided with knurling to facilitate removal from a mold, and the upper surfaces of the base and lid can be embossed during molding with decorative designs, the brand name of the product and instructions for use.

The configuration of the closure with the elevated rear land with the pivot recess disposed therein permits an inner safety seal to be installed on the container in contact with the underside of the base. Typically, the circular foil and polyethylene seal is placed inside the closure base, which is then screwed onto the container and then treated ultrasonically to melt and fuse the seal to the upper rim of the container. In closures wherein the hinge structure extends beneath the underside of the cover portion, the placement of an inner seal on the container is foreclosed. Moreover, disposing the hinge structure of the closure out of contact with the container contents avoids potential product contamination.

Referring particularly to FIGS. 1 and 4, the front of the annular skirt 20 is provided with a recess 48 at the juncture of the base skirt 20, and the upper surface 16. The downwardly extending lid skirt 42 overhangs the annular side wall 20 above the recess 48, as shown in FIG. 4, to facilitate raising of the lid 14 by the user's finger or fingernail.

Figure 9:
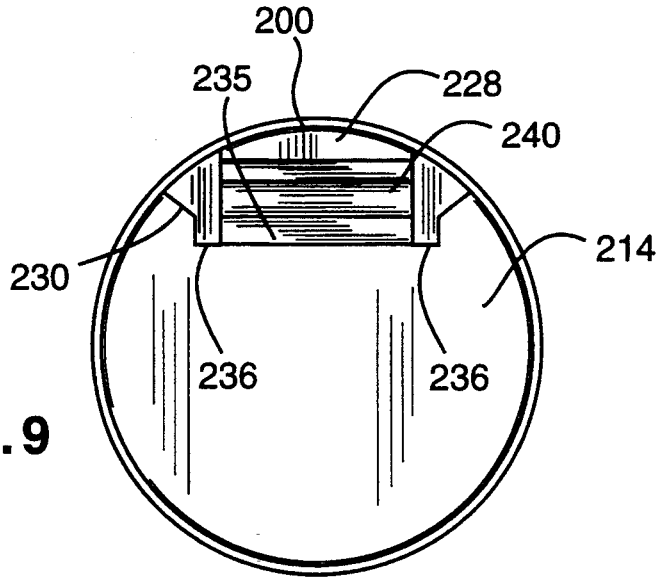
FIG. 9 is a plan view of a closure in accordance with a further embodiment of the present invention.
Figure 10:
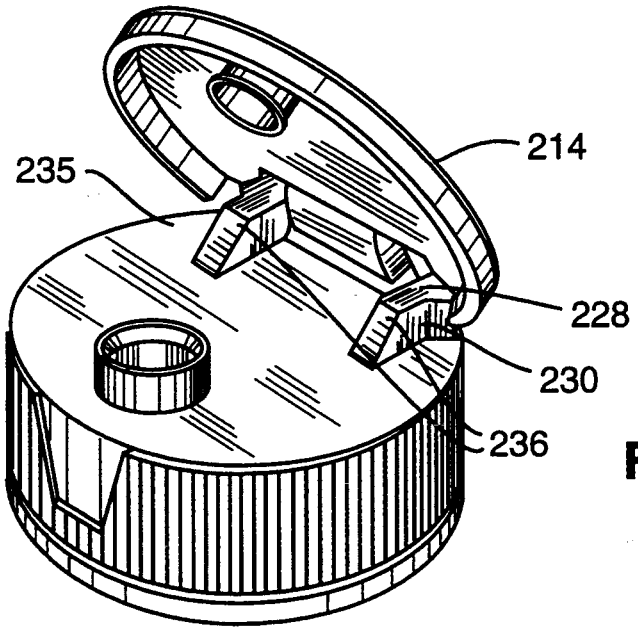
FIG. 10 is a perspective view of the closure of FIG. 9, with the lid partially open.

FIGS. 9–10 illustrate another embodiment of the present invention in which the forward portions of the sides of the elevated land 228 are chamfered to decrease the amount of plastic material required to mold the cap. This lessens the cost of the cap, as well as providing for more even cooling after molding, as compared to the elevated land 228 in FIGS. 1–7. The elevated land can be defined in part by a pair of forward walls, with their origins on the periphery of the base and their terminuses within the periphery of the base, wherein the origins are rearward of the terminuses. In the embodiment of FIGS. 9–10, the forward walls comprise the side walls 230 and the front walls 236. The side walls 230 extend from the periphery of the base 200, rearwardly of the front wall 236, to the front wall 236. A groove 235 is located in the pivot post 240. The groove 235 can be located in other portions of the lid, if required. A recessed lid as shown in FIG. 8, could also be used. All other portions of the closure are the same as described with respect to FIGS. 1–7.

Figure 11:
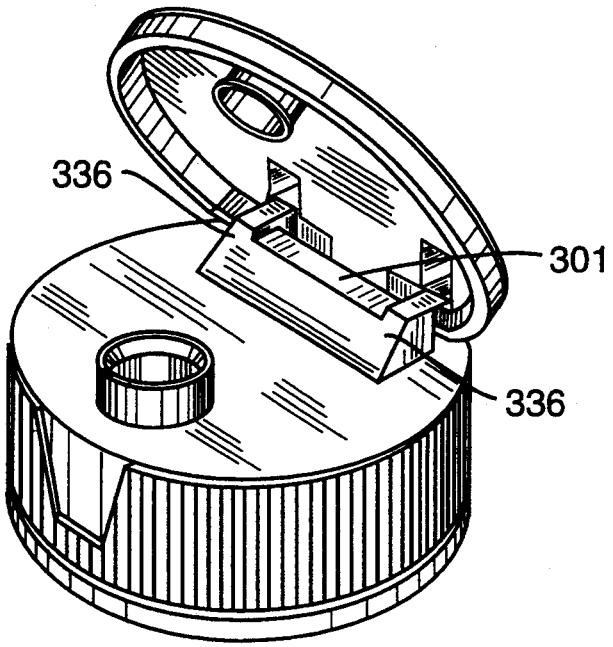
FIG. 11 is a perspective view of a further embodiment of the present invention.

The chamfered elevated land 78 can be used without the groove 235, as shown in U.S. Pat. No. Des. 334,538 and in FIG. 11. In FIG. 11, a ridge 301 is provided between the front walls 336. U.S. Pat. No. Des. 334,538 is incorporated by reference herein.

Figure 12:
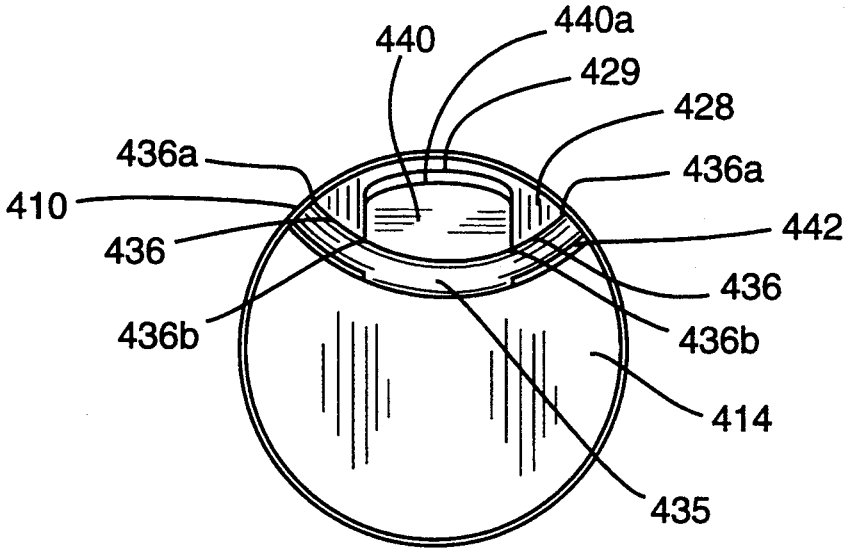
FIG. 12 is a plan view of a closure in accordance with another embodiment of the present invention.

FIG. 12 is a plan view of another embodiment of the present invention, which also provides a chamfered elevated land 428 and a recess or groove 435. The forward walls 436 of the elevated land 428 have their origins **436*a* along the periphery of the base 410 and their terminuses 436*b* within the periphery of the base 410. The origins 436*a* are rearward of the terminuses 436*b*. The forward walls 436 are shown curved. They could be straight, or of some other shape, as well. The rear wall 429 of the elevated land 428 is also preferably curved, further decreasing the plastic material required for molding. The rear portion of the pivot post 440 is similarly curved to match the contour of the rear wall 429. The forward walls 436 are preferably perpendicular to the top of the elevated land 428. The elevated land 428 requires less plastic material to mold than the elevated land 28 of FIGS. 1–7**.

Figure 13:
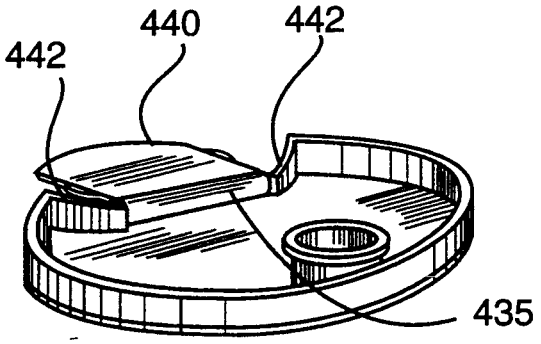
FIG. 13 is a perspective view of the bottom of lid of the embodiment of FIG. 12.

A recess or groove 435 extends across the width of the pivot post 440. The lid 414 can have a pair of rear walls 442 depending, preferably perpendicularly, from the top surface of the lid and following the contour of the front walls 436, but separated from the front walls 436 by the thickness of the recess 435. The rear walls 442 engage the base 410 when the lid 414 is in a closed position, closing off the portion of the base including the dispensing orifice. FIG. 13 is a perspective view of the bottom of the lid 414 showing the bottom of the recess 435 and the rear walls 442. The rear of the lid can meet the front walls 436 of the elevated land 428, as well. Rear walls on the lid would not then be necessary. A lid with a recess as in FIG. 8 can also be used.

Figure 14:
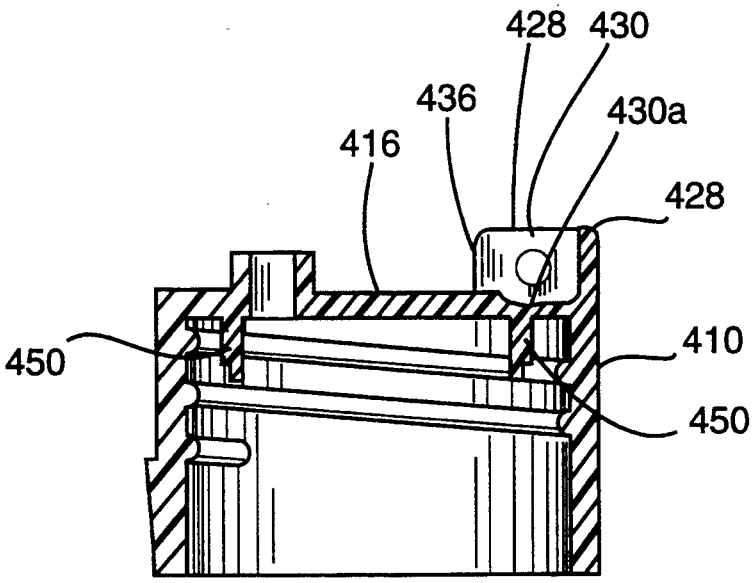
FIG. 14 is a vertical cross-sectional view similar to FIG. 4, of another embodiment of the base.

FIG. 14 is a cross-sectional view of the base 410 of FIG. 12. The bottom of the pivot recess 430 of the elevated land 428 has a depressed region 430a for accommodating the curved rear portion **440*a* of the pivot post 440**.

FIG. 14 also shows an inner sealing ring 450 depending from the bottom of the cover portion 416 of the base 410. As is known in the art, such a sealing ring can optionally be provided when an inner safety seal is not desired or necessary. The ring 450 seals against the inside surface of the neck of a container. Such a sealing ring can be used in conjunction with any of the embodiments of the invention shown herein. The embodiment of FIGS. 12–14 can be used with an inner safety seal, without the sealing ring 450, as well.

The elevated land 428 can be used in a two piece dispensing closure which does not include a recess in its lid, as well.

It is obvious that minor changes may be made in the form and construction of the invention without departing from the material spirit thereof. It is not, however, desired to confine the invention to the exact form herein shown and described, but it is desired to include all such as properly come within the scope claimed.

We claim:

1. A two piece dispensing closure for a container, the closure comprising:

a base member having a top surface portion and a skirt depending downwardly from the top surface portion, said top surface portion having a dispensing orifice;

a lid having a pivot post, a top surface and a bottom surface with a plug for sealing the dispensing orifice;

an elevated land contiguous to the top surface portion and spaced from the dispensing orifice, said elevated land having a pivot recess spaced from its periphery bordering the skirt of the base for receiving the pivot post of the lid, said pivot recess being disposed so as to align the plug with the dispensing orifice and thereby allow mating of the plug and orifice; and the lid further comprising a recess in its top surface for receiving a portion of the elevated land when the lid is rotated to a fully opened position., the top recess being forward of a portion of the pivot post received in the pivot recess.

2. The closure of claim 1 wherein the recess in the lid extends from the pivot post to the front of the lid.

3. The closure of claim 1 wherein the elevated land is defined in part by a pair of front walls within the periphery of the base and a pair of side walls extending from a portion of the periphery of the base rearward of the front walls, to the front walls.

4. The closure of claim 1 wherein the lid, when in a fully opened position, can be rotated to about 150° from the closed position of the lid.

5. The closure of claim 1 wherein the pivot recess has a bottom surface which extends below the top surface portion of the base.

6. The closure of claim 1 wherein the elevated land is defined in part by a pair of forward walls each having an origin along the periphery of the base and a terminus within the periphery of the base, each origin being rearward of each terminus.

7. The closure of claim 6 wherein the forward walls are curved.

8. The closure of claim 1 wherein the recess is a groove.

9. The closure of claim 8 wherein the groove extends across the width of the pivot post.

10. The closure of claim 8 wherein the elevated land is defined in part by a pair of front walls within the periphery of the base and a pair of side walls extending from a portion of the periphery of the base rearward of the front walls, to the front walls.

11. The closure of claim 8 wherein the lid, when in a fully opened position, can be rotated to about 150° from the closed position of the lid.

12. The closure of claim 8 wherein the elevated land is defined in part by a pair of forward walls each having an origin along the periphery of the base and a terminus within the periphery of the base, each origin being rearward of each terminus.

13. The closure of claim 12 wherein the forward walls are curved.

14. A two piece dispensing closure for a container, the closure comprising:

a base member having a top surface portion and a skirt depending downwardly from the top surface, said top surface portion having a dispensing orifice;

a lid having a bottom surface with a plug for sealing the dispensing orifice;

an elevated land contiguous to the top surface portion and spaced from the dispensing orifice, said elevated land having a pivot recess spaced from its periphery bordering the skirt of the base for pivotally affixing the lid, said pivot recess being disposed so as to align the plug with the dispensing orifice and thereby allow mating of the plug and orifice, wherein the elevated land is defined in part by a pair of forward walls each having an origin along the periphery of the base and a terminus within the periphery of the base, each origin being rearward of each terminus.

15. The closure of claim 14 wherein the forward walls are curved.

16. The closure of claim 14 wherein the forward walls further comprise a pair of front walls within the periphery of the base and a pair of side walls extending from a portion of the periphery of the base rearward of the front walls, to the front walls.

17. The closure of claim 14 wherein the lid further comprises a recess in its top surface for receiving a portion of the elevated land when the lid is rotated to a fully opened position.

18. The closure of claim 14 wherein the lid further comprises a recess for receiving a portion of the elevated land when the lid is rotated to a fully opened position.

19. A two piece dispensing closure for a container, the closure comprising:

a generally circular base having a top and a front section, the base comprising a cover portion at least partially spanning the top of the base and having a generally semi-circular forward top surface in the front section of the base, and an annular skirt depending downwardly from the cover portion;

a dispensing orifice in the generally semi-circular forward top surface of the cover portion, wherein the dispensing orifice has a rim and the top surface portion does not extend above the rim;

a lid having a bottom surface with a plug for sealing the dispensing orifice and a pivot post;

an elevated rear land extending upwardly from and above the annular skirt, contiguous with the generally semi-circular forward top surface of the cover portion and behind the dispensing orifice, the elevated rear land having a pivot recess spaced from its periphery for pivotally receiving the pivot post of the lid, the pivot recess being disposed to align the plug with the dispensing orifice and thereby allow mating of the plug and orifice when the lid is in the closed position; wherein the pivot post further comprises a recess extending across its width, forward of a portion of the pivot post received in the pivot recess, for receiving a portion of the elevated land when the lid is rotated to a fully opened position.

20. A two piece dispensing closure for a container, the closure comprising:

a lid having a bottom surface with a plug for sealing a dispensing orifice and a top surface;

a base member having a top surface portion and a skirt depending downwardly from the top surface portion, said top surface portion having a dispensing orifice;

and an elevated land having a forward wall contiguous to the top surface portion and spaced from the dispensing orifice, said elevated land having a recess spaced from its periphery bordering the skirt of the base for pivotally affixing the lid, said recess being disposed so as to align the plug with the dispensing orifice and thereby allow mating of the plug and orifice, wherein the sides of the elevated land are chamfered between the forward wall and the periphery.

* * * * *